US010115356B2

(12) United States Patent
Endo et al.

(10) Patent No.: US 10,115,356 B2
(45) Date of Patent: Oct. 30, 2018

(54) LIQUID CRYSTAL DISPLAY DEVICE AND A METHOD FOR DRIVING THEREOF WITH A FIRST AND SECOND LCD PANEL

(71) Applicant: Panasonic Liquid Crystal Display Co., Ltd., Hyogo (JP)

(72) Inventors: Kenta Endo, Hyogo (JP); Kazuhiko Tsuda, Hyogo (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 0 days.

(21) Appl. No.: 15/475,171

(22) Filed: Mar. 31, 2017

(65) Prior Publication Data

US 2018/0286326 A1 Oct. 4, 2018

(51) Int. Cl.
*G09G 3/36* (2006.01)
*G09G 3/00* (2006.01)

(52) U.S. Cl.
CPC ..... *G09G 3/3607* (2013.01); *G09G 3/006* (2013.01); *G09G 2300/023* (2013.01); *G09G 2330/10* (2013.01)

(58) Field of Classification Search
CPC ..... G09G 2300/023; G09G 2330/10; G09G 3/3607; G09G 3/006; G02F 1/347; G02F 1/1347; H04N 13/0495
USPC ..... 345/4–6
See application file for complete search history.

(56) References Cited

U.S. PATENT DOCUMENTS

| | | | | |
|---|---|---|---|---|
| 7,440,074 | B2 | 10/2008 | Umetsu | |
| 8,451,201 | B2 | 5/2013 | Hirata et al. | |
| 2008/0117231 | A1* | 5/2008 | Kimpe | G09G 3/20 345/629 |

* cited by examiner

*Primary Examiner* — Rodney Amadiz
(74) *Attorney, Agent, or Firm* — HEA Law PLLC

(57) ABSTRACT

An apparatus and method for a liquid crystal display (LCD). The LCD can include a first LCD panel, a second LCD panel stacked on the first LCD panel, and a data processor that generates, based on an external input image signal, a first image data for the first LCD panel and a second image data for the second LCD panel. The data processor may further include a memory storing a position of a defective pixel of a white spot and a controller changing a gray scale level of a first pixel using the position of the defective pixel, the first pixel at least partially overlapping the position of the defective pixel, wherein the defective pixel is in the first LCD panel and the first pixel is in the second LCD panel.

8 Claims, 8 Drawing Sheets

LIQUID CRYSTAL DISPLAY DEVICE AND A METHOD FOR DRIVING THEREOF WITH A FIRST AND SECOND LCD PANEL

BACKGROUND

During manufacturing, liquid crystal displays (LCDs) have a generally accepted imperfection or defect rate. A significant amount of LCD panels fail initial quality testing based on the amount or type of defects in the LCD panels, resulting in those products being destroyed. However, LCDs with an acceptable amount of defects are kept and ultimately put on sale or otherwise distributed.

Among the defects which are considered acceptable for LCDs are light spot defects and black spot defects. In particular, in dual panel LCDs, such defects are well known and routinely found during manufacturing inspections. In such situations, the LCDs are formed with a first LCD panel stacked on top of a second LCD panel, where the first panel produces a first display from a first image data and the second panel produces a second display from a second display signal that is derived from the first image data. Defective pixels on the first or second LCD panel will then deteriorate the overall quality of the image displayed to a user.

In situations involving a normally white LCD, where pixels are white when voltage is not applied, pixels that are defective allow light to pass through when voltage is applied, causes resulting light spot defects. In other words, instead of the pixels on the white display being driven black when voltage is applied, as intended, the pixels allow the light to pass through them and causing a defect on the displayed image because of the passed-through light. Conversely, in situations involving a normally black LCD, where pixels are black when voltage is not applied, pixels that are defective remain black when voltage is applied instead of being driven white. This results in a black spot defect.

In practical use, light spot defects are more perceptible to the human eye when viewing such a display. Black spot defects, however, are much less perceptible during typical viewing of an LCD. Therefore, there is a higher tolerance for black spot defects on LCDs than there is for white spot defects. As a result, manufactured LCDs with light spot defects above a threshold level are typically scrapped. However, manufactured LCDs with light spot defects below a threshold level are often converted to black spot defects during inspection associated with the manufacture of LCDs. Manufactured LCDs with black spot defects have a higher threshold for the amount of defects before they are scrapped This is considered acceptable due to the black spot defects being less perceptible to a viewer.

However, black spot defects still deteriorate the overall quality of an image displayed on an LCD. In particular, where LCDs are formed with first and second LCD panels, and a back panel has large pixels, the effect of a black spot defect on the front panel is often enhanced. As is often the situation, a back panel of an LCD may have pixels that correspond to three sub-pixels on a front panel, so black spot defects on the back panel can cause significant image deterioration. Thus, and LCD that provides a way of mitigating black spot defects is desired.

SUMMARY

In one exemplary embodiment, an apparatus for a liquid crystal display (LCD) may be shown and described. The LCD can include a first LCD panel, a second LCD panel stacked on the first LCD panel, and a data processor that generates, based on an external input image signal, a first image data for the first LCD panel and a second image data for the second LCD panel. The data processor in the LCD may further include a memory storing a position of a defective pixel of white spot and a controller changing a gray scale level of a first pixel using the position of the defective pixel, the first pixel at least partially overlapping the position of the defective pixel, wherein the defective pixel is in the first LCD panel and the first pixel is in the second LCD panel. Additionally, the controller can changes a gray scale level of the first pixel to be darker than a gray scale level corresponding to the first pixel based on the external input image signal.

An apparatus for an LCD may be further described in another exemplary embodiment. Here, the LCD can include a first LCD panel; a second LCD panel stacked on the first LCD panel; and a data processor that generates, based on an external input image signal, a first image data for the first LCD panel and a second image data for the second LCD panel. In this embodiment, the data processor includes a memory storing a position of a defective pixel of black spot and a controller changing a gray scale level of a first pixel using the position of the defective pixel, the first pixel at least partially overlapping the position of the defective pixel and the defective pixel is in the first LCD panel and the first pixel is in the second LCD panel. Further, the controller changes a gray scale level of the first pixel to be brighter than a gray scale level corresponding to the first pixel based on the external input image signal.

In yet another exemplary embodiment, further examples of an LCD may be described. Here, the LCD can have a first LCD panel; a second LCD panel stacked on the first LCD panel; and a data processor that generates, based on an external input image signal, a first image data for the first LCD panel and a second image data for the second LCD panel. In this embodiment, the data processor includes a memory storing a position of a defective pixel of white spot, the defective pixel and a non-defective pixel are in the first LCD panel and a first pixel and a second pixel are in the second LCD panel, the first pixel being at least partially overlaps the defective pixel and the second pixel being at least partially overlaps the non-defective pixel, and, when a gray scale level corresponding to the first pixel and the second pixel are the same based on the external input image signal, the data processor generates the second image data using the position of the defective pixel and the first pixel displays darker luminescence than the second pixel does according to the second image data.

Another exemplary embodiment describes additional elements of an LCD. Here, the LCD can include a first LCD panel; a second LCD panel stacked on the first LCD panel; and a data processor that generates, based on an external input image signal, a first image data for the first LCD panel and a second image data for the second LCD panel. In this exemplary embodiment, the data processor includes a memory storing a position of a defective pixel of black spot, the defective pixel and a non-defective pixel are in the first LCD panel and a first pixel and a second pixel are in the second LCD panel, the first pixel being at least partially overlaps the defective pixel and the second pixel being at least partially overlaps the non-defective pixel, and, when a gray scale level corresponding to the first pixel and the second pixel are same based on the external input image signal, the data processor generates the second image data using the position of the defective pixel and the first pixel displays brighter luminescence than the second pixel does according to the second image data.

Still another exemplary embodiment can describe a method of providing a display with an LCD. The method can include generating, by a data processor, first image data for a first LCD panel and second image data for a second LCD panel stacked on the first LCD panel; and changing, by the data processor, a gray scale level of a first pixel to be darker than a gray scale level corresponding to the first pixel based on an external input image signal. In the method, the first pixel in a first LCD panel at least partially overlaps the position of the defective pixel of white spot in the second LCD panel in a plan view.

In another exemplary embodiment, a further method for providing a display on and LCD can include generating, by a data processor, first image data for a first LCD panel and second image data for a second LCD panel stacked on the first LCD panel; and changing, by the data processor, a gray scale level of a first pixel to be brighter than a gray scale level corresponding to the first pixel based on an external input image signal. Here, the first pixel in a first LCD panel at least partially overlaps the position of the defective pixel of black spot in the second LCD panel in a plan view.

BRIEF DESCRIPTION OF THE FIGURES

Advantages of embodiments of the present disclosure will be apparent from the following detailed description of the exemplary embodiments thereof, which description should be considered in conjunction with the accompanying drawings in which like numerals indicate like elements, in which.

DETAILED DESCRIPTION

Figure 1:
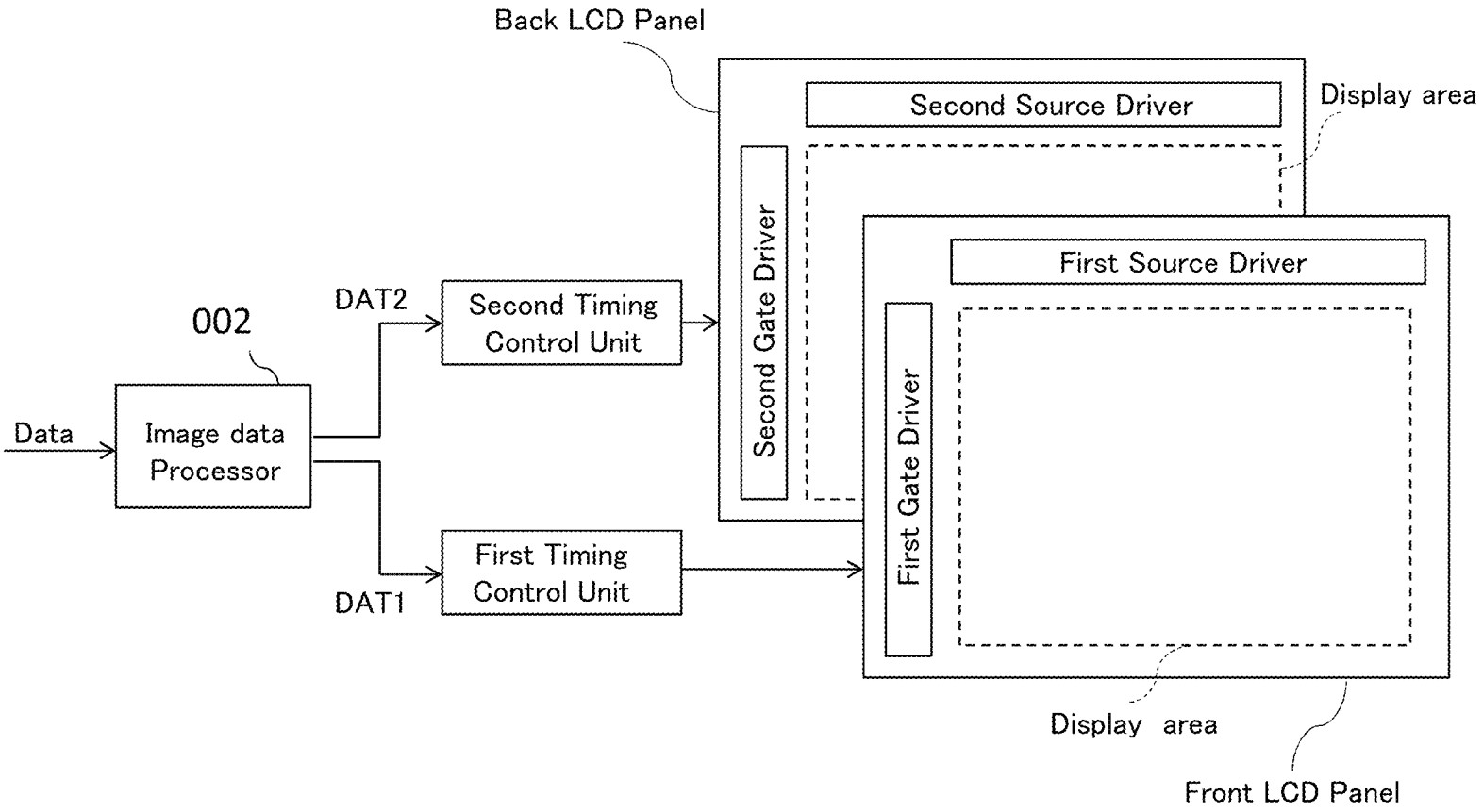
FIG. 1 is a schematic plan view of a liquid crystal display according to an exemplary embodiment.

Aspects of the invention are disclosed in the following description and related drawings directed to specific embodiments of the disclosures. Alternate embodiments may be devised without departing from the spirit or the scope of the invention. Additionally, well-known elements of exemplary embodiments will not be described in detail or will be omitted so as not to obscure the relevant details of the disclosures. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Further, many of the embodiments described herein are described in terms of sequences of actions to be performed by, for example, elements of a computing device. It should be recognized by those skilled in the art that the various sequences of actions described herein can be performed by specific circuits (e.g. application specific integrated circuits (ASICs)) and/or by program instructions executed by at least one processor. Additionally, the sequence of actions described herein can be embodied entirely within any form of computer-readable storage medium such that execution of the sequence of actions enables the at least one processor to perform the functionality described herein. Furthermore, the sequence of actions described herein can be embodied in a combination of hardware and software. Thus, the various aspects of the present disclosure may be embodied in a number of different forms, all of which have been contemplated to be within the scope of the claimed subject matter. In addition, for each of the embodiments described herein, the corresponding form of any such embodiment may be described herein as, for example, "a computer configured to" perform the described action.

According to an exemplary embodiment, and referring to the Figures generally, a liquid crystal display (LCD) device and a method for driving LCD may be provided. According to one exemplary embodiment, defects in panels of an LCD may be corrected.

A liquid crystal displays (LCDs) according to the exemplary embodiment may include a plurality of display panels for displaying images, a plurality of drive circuits (a plurality of source drive, a plurality of gate drivers, for example) for driving the respective display panels, and a plurality of timing control units controlling each of the drive circuits, an image signal generating unit which performs image processing on an external input image signal and outputs image data to each timing control unit, and a backlight to illuminate light on the plurality of display panels from the back side. The number of display panels is not limited and may be two or more. In addition, the plurality of display panels are arranged so as to overlap each other in the front-rear direction when viewed from the viewer side. The plurality of display panels may be arranged to each display an image. Hereinafter, a liquid crystal display device having two display panels will be described as an example.

Turning now to exemplary FIG. 1, FIG. 1 is a plan view showing a schematic configuration of liquid crystal displays (LCDs) according to the exemplary embodiment. As shown in FIG. 1, the liquid crystal displays 001 includes a front LCD panel 101 arranged at a position close to the viewer (front side) and a back LCD panel 102 arranged at a position farther from the viewer (rear side) than the front LCD panel. The front LCD panel receives various timing signals from a first timing control unit for controlling a first source driver and a front gate driver. The back LCD panel 102 receives various timing signals from a second timing control unit for controlling a second source driver and a second gate driver. An image data processor 002 outputs a first image data DAT1 to the first timing control unit and outputs a second image data DAT2 to the second timing control unit. The front LCD panel 101 displays a color image according to the external input image signal, and the back LCD panel 102 displays a black and white (monotonic) image according to the external input image signal.

Figure 2:
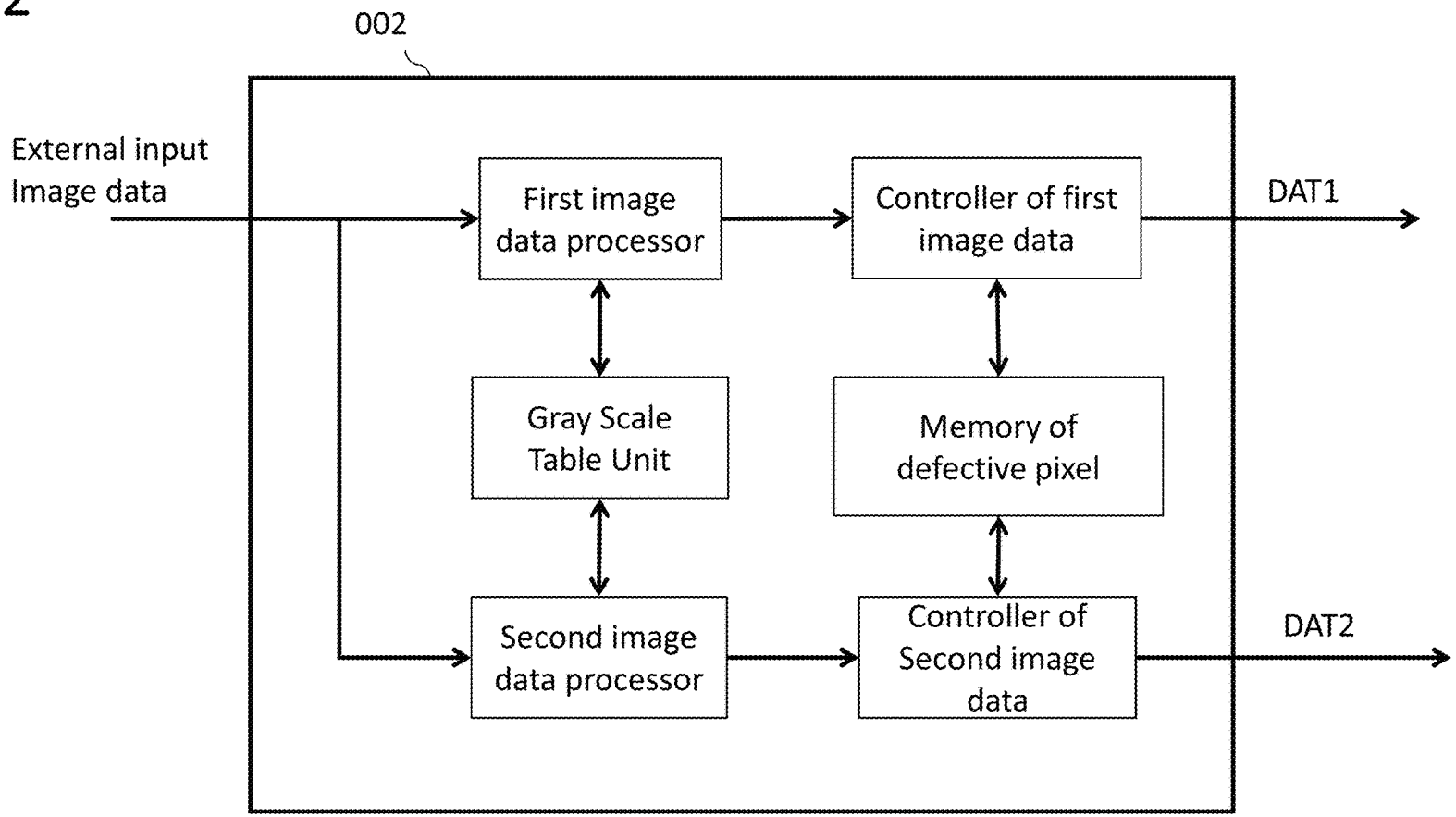
FIG. 2 is a block diagram of an image data processor according to an exemplary embodiment.

Turing now to exemplary FIG. 2, FIG. 2 is a block diagram of the image data processor 002. The image data processor 002 may include a first image signal generator, a second image data processor, a gray scale table unit, a controller of first image data, a controller of second image data, and memory of defective pixel of light and black spots. The first image data processor performs an image processing by receiving an external input image data. The second image data processor performs an image processing so as to increase contrast in luminescence and suppress the adverse effects of moire fringes and oblique parallax by for example, a maximum value filter and/or an average value filter. The first and second image data generators perform the image processing based on gray scale tables stored in the gray scale table unit. The memory of defective pixel stores at least positional information where a defective pixel of light spot or/and a black spot is present. Liquid crystal display device providers inspect whether a defective pixel of light spot or/and a black spot is present or not, and where it locates, if any, before they distribute their products. They stores positional information about these defects in this memory. The controller of first image data performs image processing on an output from the first image data processor so as to hide defective pixel of light spot or black spot formed in the back LCD panel 102 or to make it imperceptible. The controller of second image data performs image processing on an output from the second image data processor so as to hide a defective pixel of light spot or black spot formed in the front LCD panel 101 or to make it imperceptible. A location of the defect pixel or an overlapping pixel which overlaps the defect pixel formed in another LCD panel may also be stored at the memory.

Figures 3A, 3B:
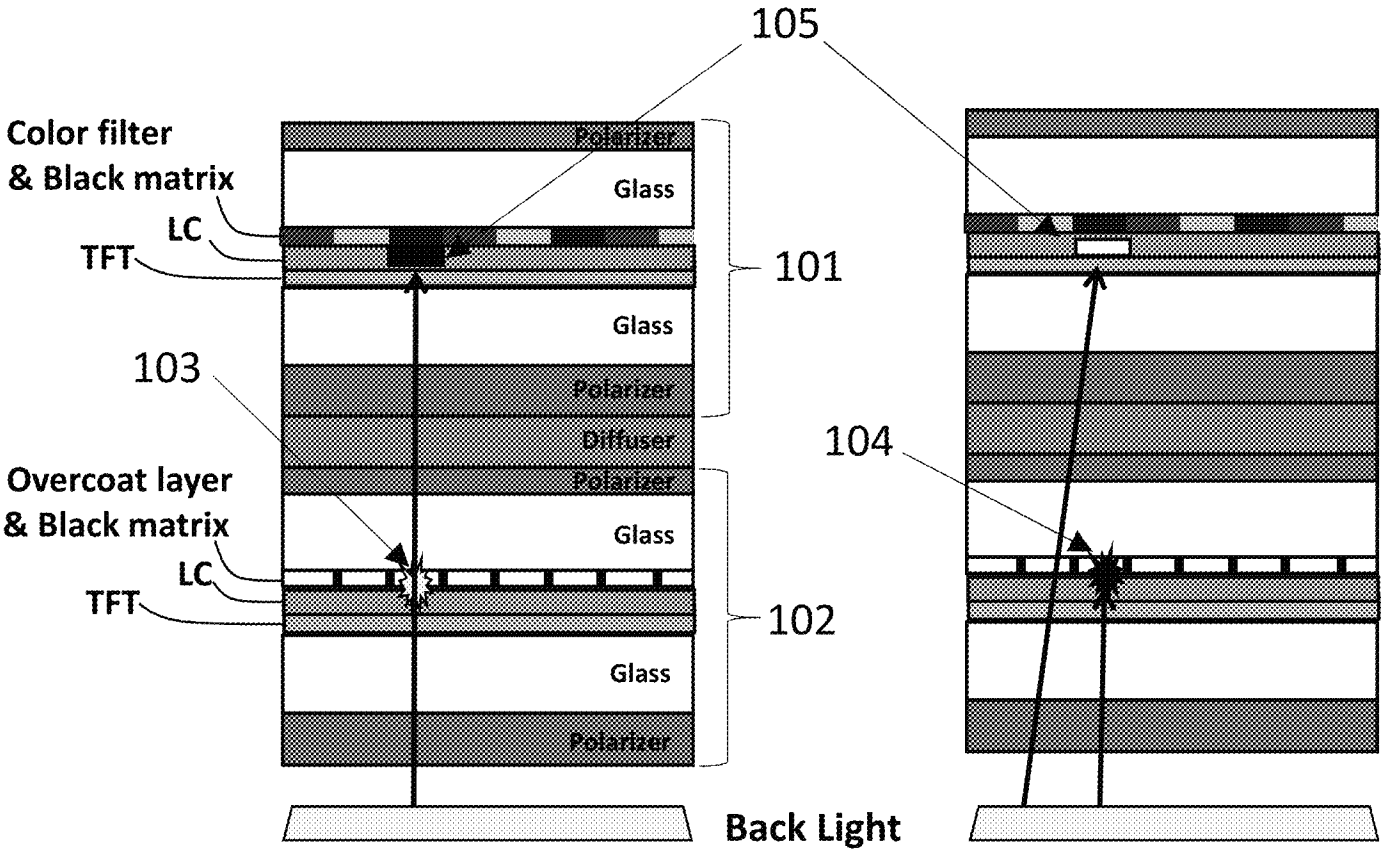
FIGS. 3A and 3B are schematic cross-sectional views of liquid crystal displays where the white spot defect and the black spot defect are corrected according to an exemplary embodiment.

Referring to exemplary FIGS. 3A and 3B, FIGS. 3A and 3B show schematic cross-sectional views of liquid crystal displays (LCDs) where white spot defect and black spot defect are corrected according to an exemplary embodiment. In an exemplary embodiment, the LCDs may be formed with two LCD panels: the front LCD panel 101 and the back LCD panel 102. The front LCD panel 101 may be stacked on the back LCD panel 102. In exemplary FIGS. 3A and 3B, the front LCD panel 101 may display color image data and the back LCD panel 102 may display monotonic image data.

Also, in an exemplary embodiment, the front LCD panel 101 may produce a first display from a first image data DAT1 and the back LCD panel 102 may produce a second display from a second display signal DAT2. The first and second display signal may be generated by the image data processor 002. The image data processor 002 may generate the first and second display signal based on an external input image signal, or irrespective of the external input image source. Also, the second display may be derived from the first image data. Both display signals may be from the same external input image source.

In an exemplary embodiment, the light spot defect 103 may be on the one of the front and back LCD panels 101, 102. Referring to exemplary FIGS. 3A and 3B, it is presumed that the light spot defect 103 is on the back LCD panel 102. As described above, the image data processor 102 may include the memory of defective pixel which stores positional information of the defective pixel 103. The image data processor 102 may also include a controller which may change the gray scale level of either LCD panels. In particular, the controller may find a pixel 105 which overlaps the position of the defective pixel 103 through the positional information in the memory of defective pixel and may change the gray scale level of the pixel to hide the light spot 103. As shown in FIG. 3A, the overlapping pixel 105 may be on the front LCD panel 101 if the light spot defect 103 is on the back LCD panel 102. Also, according to another exemplary embodiment, the overlapping pixel 105 may be on the back LCD panel 102 if the light spot defect 103 is on the front LCD panel 101. In an exemplary embodiment, the controller may change the gray scale level of the overlapping pixel 105 to be darker than a gray scale level which should have been displayed on the overlapping pixel 105 based on the external input image signal. Thus, the white spot defect 103 may be hidden because the amount of light which leaks through the white spot defect 103 can be blocked by the overlapping pixel 105, and, in this manner, human eyes may not recognize the white spot defect 103. Also, in another exemplary embodiment, the controller may change the gray scale level of the overlapping pixel 105 to be a predetermined gray scale level irrespective of the external input image signal.

Still referring to exemplary FIG. 3B, FIG. 3B also shows the LCD which has a black spot defect 104. In exemplary FIG. 3B, it is also presumed the black spot defect 104 is on the back LCD panel 102, but the black spot defect 104 may be on the front LCD panel 101 in another exemplary embodiment. The controller may change the gray scale level of a pixel 105 which overlaps the black spot defect 104 to be brighter than a gray scale level which should have been displayed on the pixel 105 based on the external input image data. Thus, the black spot defect 104 may be hidden because the amount of back light which is blocked by the black spot defect 104 can be compensated with the amount of back light which passes through the overlapping pixel 105, and, in this manner, human eyes may not recognize the black spot defect 104.

Figure 4:
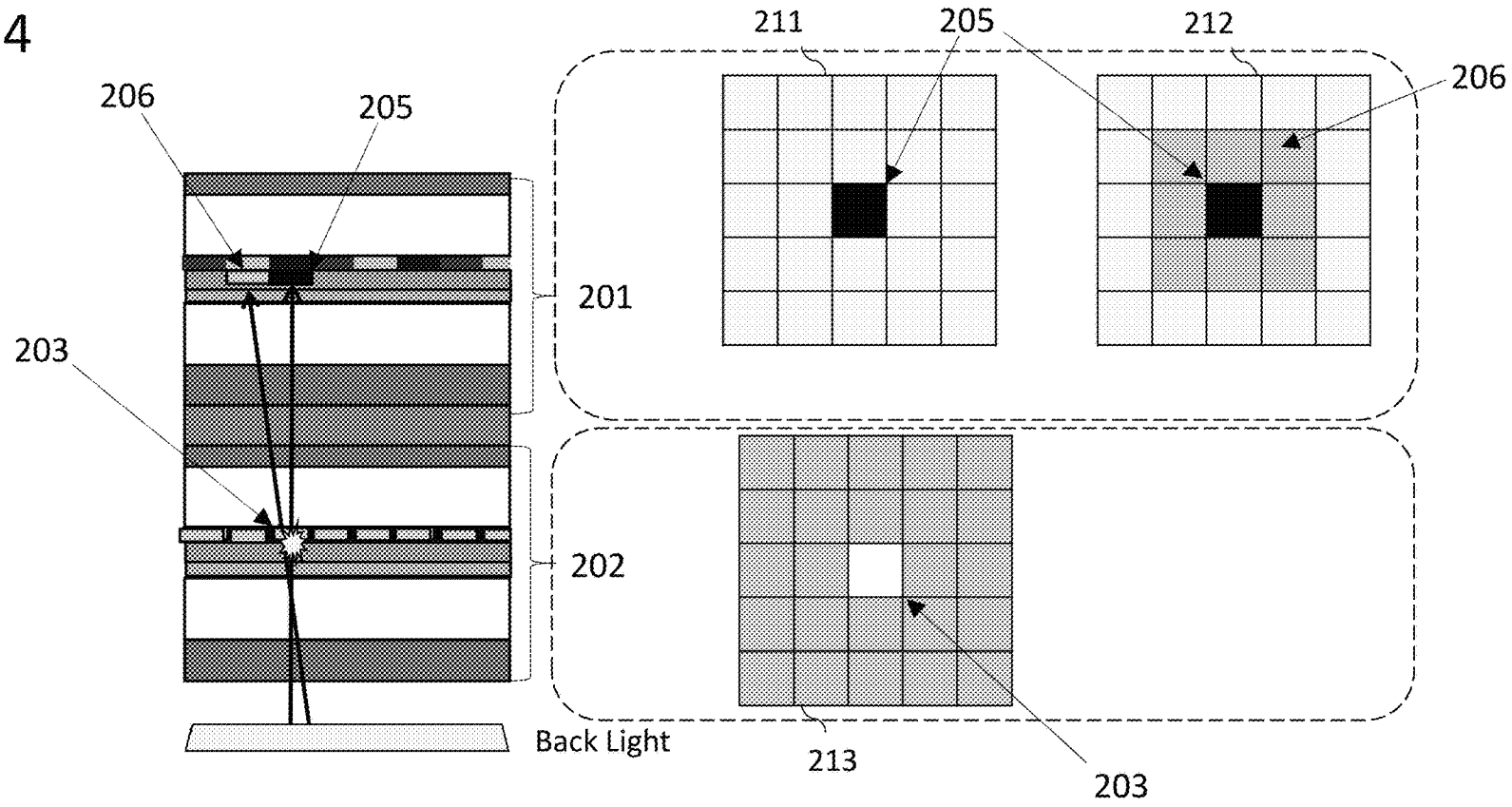
FIG. 4 is a schematic cross-sectional view of a liquid crystal display where the white spot defect is corrected according to an exemplary embodiment.

Turing to exemplary FIG. 4, FIG. 4 shows how the white spot defect 203 on the back LCD panel 202 is hidden by the overlapping pixel 205 and its adjacent pixels 206 on the front LCD panel 201 according to an exemplary embodiment. As shown in a schematic cross-sectional views of liquid crystal displays of FIG. 4, the light which leaks through the white spot defect 203 may reach not only the overlapping pixel 205, but also pixels 206 adjacent to the overlapping pixel 205. Thus, according to an exemplary embodiment, the image data processor 102 may change the gray scale levels of the adjacent pixels 206 as well as the overlapping pixel 205 to be darker than gray scale levels which should have been displayed on the overlapping pixel 205 and the adjacent pixels 206 based on the external input image signal as shown in a plan view 212 of the front LCD panel 201. Thus, the white spot defect 203 may be blocked by the overlapping pixel 205 and the adjacent pixels 206, and, in this manner, human eyes may not recognize the white spot defect 203. For example, the overlapping pixel 205 may be controlled to be darker by 50% than the gray scale level which should have been displayed on the overlapping pixel 205 based on the external input image signal, and the adjacent pixels 206 may be controlled to be darker by 25% than the gray scale level which should have been displayed on the adjacent pixels 206 based on the external input image signal. Also, in another exemplary embodiment, the image data processor 102 may change the gray scale level of the overlapping pixel 205 and the adjacent pixel 206 to be each predetermined gray scale level irrespective of the external input image signal. For example, the memory of defective pixel may store a block pattern of pixels such as the overlapping pixel 205 to be zero gray scale (black) and the adjacent pixels 206 surrounding the overlapping pixel 205 to be "20" gray scale, where the overlapping pixel 205 and the adjacent pixels 206 display the block pattern irrespective of the external input image signal.

According to an exemplary embodiment, the amount of gray scale level which is to be displayed on the overlapping pixel 205 or the adjacent pixel 206 may be determined by considering the amount of the back light which reach the overlapping pixel 205 or the adjacent pixel 206 after leaking through the white spot defect 203. Also, the amount of gray scale level which is to be displayed on the overlapping pixel 205 or the adjacent pixel 206 may be determined by considering the external input image data, or etc.

Figure 5:
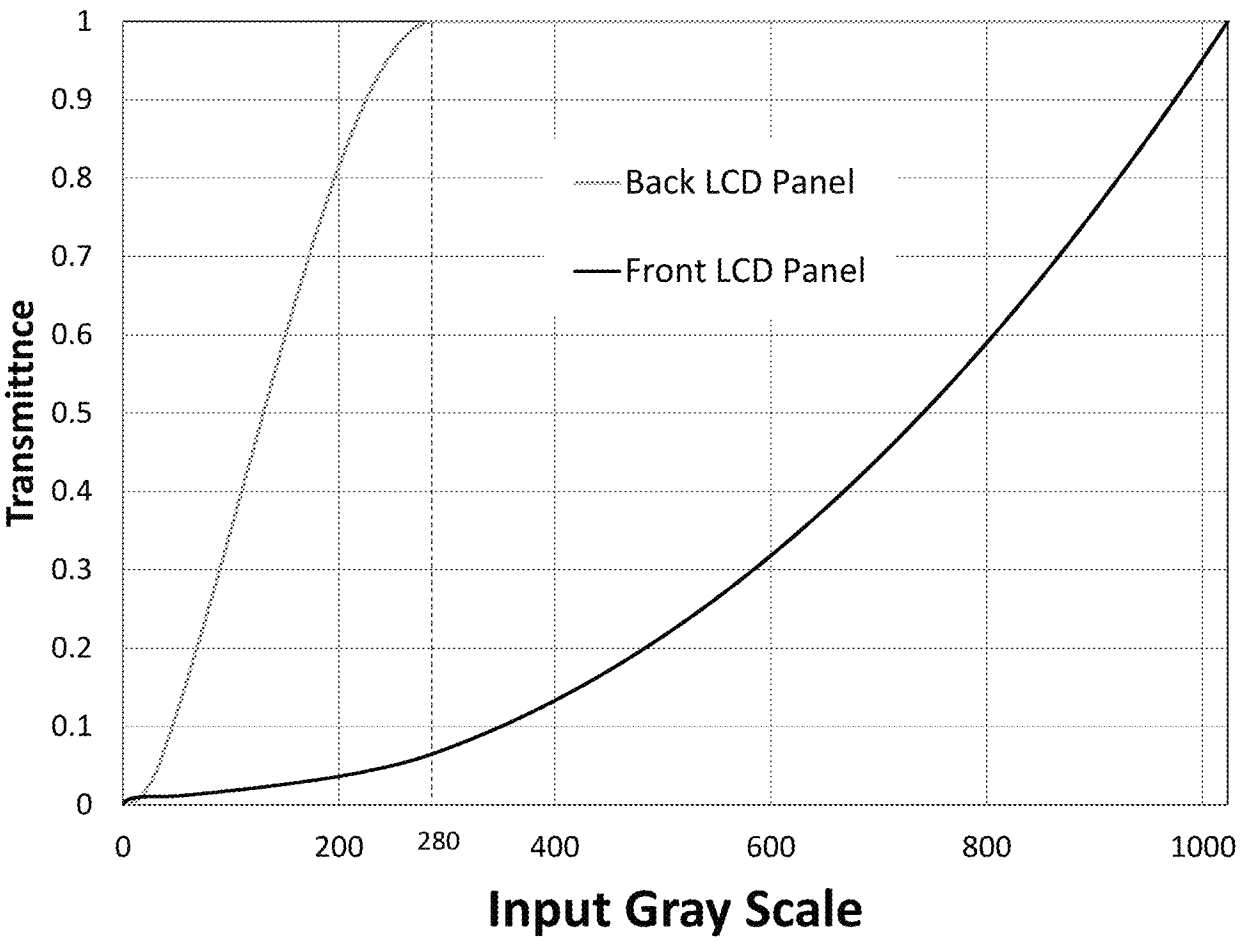
FIG. 5 illustrates exemplary gray scale carves for the front LCD panel and the back LCD panel.

Also, in another exemplary embodiment, the image data processor 102 may check if the gray scale level corresponding to the black spot defect based on the external input image data is darker or brighter than predetermined gray scale levels. Referring to FIG. 5, for example, the back LCD panel 402 may display a monotone based on a gray scale carve shown in FIG. 5. According to the gray scale carve for the back LCD panel 402, a transmittance changes depending on the input gray scale of "0" to "280", while the transmittance is constant of maximum if the input gray scale is more than "280". Therefore, if the input gray scale is larger than "280", the overlapping pixel and adjacent pixels 206 do not need to block the back light leaked through the white spot defect 203 because the white spot defect 203 should have displayed maximum white based on the external input image signal. Thus, if the external input image data is darker than the predetermined gray scale levels (if the gray scale of the input is less than "280" as an example of FIG. 5), the controller may change the gray scale level of the overlapping pixel or the adjacent pixels to be darker than the external input image data. However, if the external input image data is brighter than the predetermined gray scale levels (gray scale of "280" in an example of FIG. 5), the controller may control the gray scale level of the overlapping pixel or the adjacent pixels to be maintained as the external input image data.

Also, in another exemplary embodiment, the image data processor 102 may check if the gray scale level corresponding to the overlapping pixel or the adjacent pixels based on the external input image data is darker or brighter than predetermined gray scale levels which are the threshold levels for human eyes not to recognize the white spot defect 203. Here, if the external input image data is darker than the predetermined gray scale, human eyes may recognize the white spot defect 203 because the external input image data would be shown brighter than it should have been displayed due to the increased luminescence by the white spot defect 203. On the other hand, if the external input image data is brighter than the predetermined gray scale, human eyes may not recognize the white spot defect 203. Thus, if the external input image data is darker than the predetermined gray scale levels, the controller may change the gray scale level of the overlapping pixel or the adjacent pixels to be darker than the external input image data. However, the external input image data is brighter than the predetermined gray scale levels, the controller may control the gray scale level of the overlapping pixel or the adjacent pixels to be maintained as the external input image data.

Also, in another exemplary embodiment, the image data processor 102 may compare the overlapping pixel 205 with non-overlapping pixels. The non-overlapping pixels may surround the overlapping pixel 205 on the same LCD panel (here, the front LCD panel 201), and the light leaked through the white spot defect 203 does not reach the non-overlapping pixels. Generally, human eyes may recognize easily an unnatural difference between adjacent pixels. Thus, if the gray scale level of the overlapping pixels 205 and the non-overlapping pixels are same based on the external input image, the controller may control the overlapping pixel 205 to display darker luminescence than the non-overlapping pixels displays (the image data processor 102 may generate the image data for the front LCD panel 201 using the defect position information stored in the memory of defective pixel where the overlapping pixel 205 displays darker luminescence than the non-overlapping pixels displays).

Also, in anther exemplary embodiment, the image data processor 102, based on the external input image, may check if the gray scale level of the overlapping pixels 205 and the non-overlapping pixels is darker than predetermined level which is the threshold level for human eyes not to recognize the white spot defect 203. If the external input image data is darker than the predetermined level, the controller may change the gray scale level of the overlapping pixels 205 to be darker than the external input image data. Also, if the external input image data is brighter than the predetermined level, the controller may control the gray scale level of the overlapping pixels 205 to be maintained as the external input image data. In another exemplary embodiment, the boundary between the overlapping pixels 205 and the non-overlapping pixels may not be strictly limited. For example, the overlapping pixels 205 may partially overlap the white spot defect 203, and the non-overlapping pixels, partially, may not overlap the white spot defect 203 (the back light leaked through the white spot defect 203 does partially reach the non-overlapping pixels, so the non-overlapping pixels may be the adjacent pixels 206).

Figure 6:
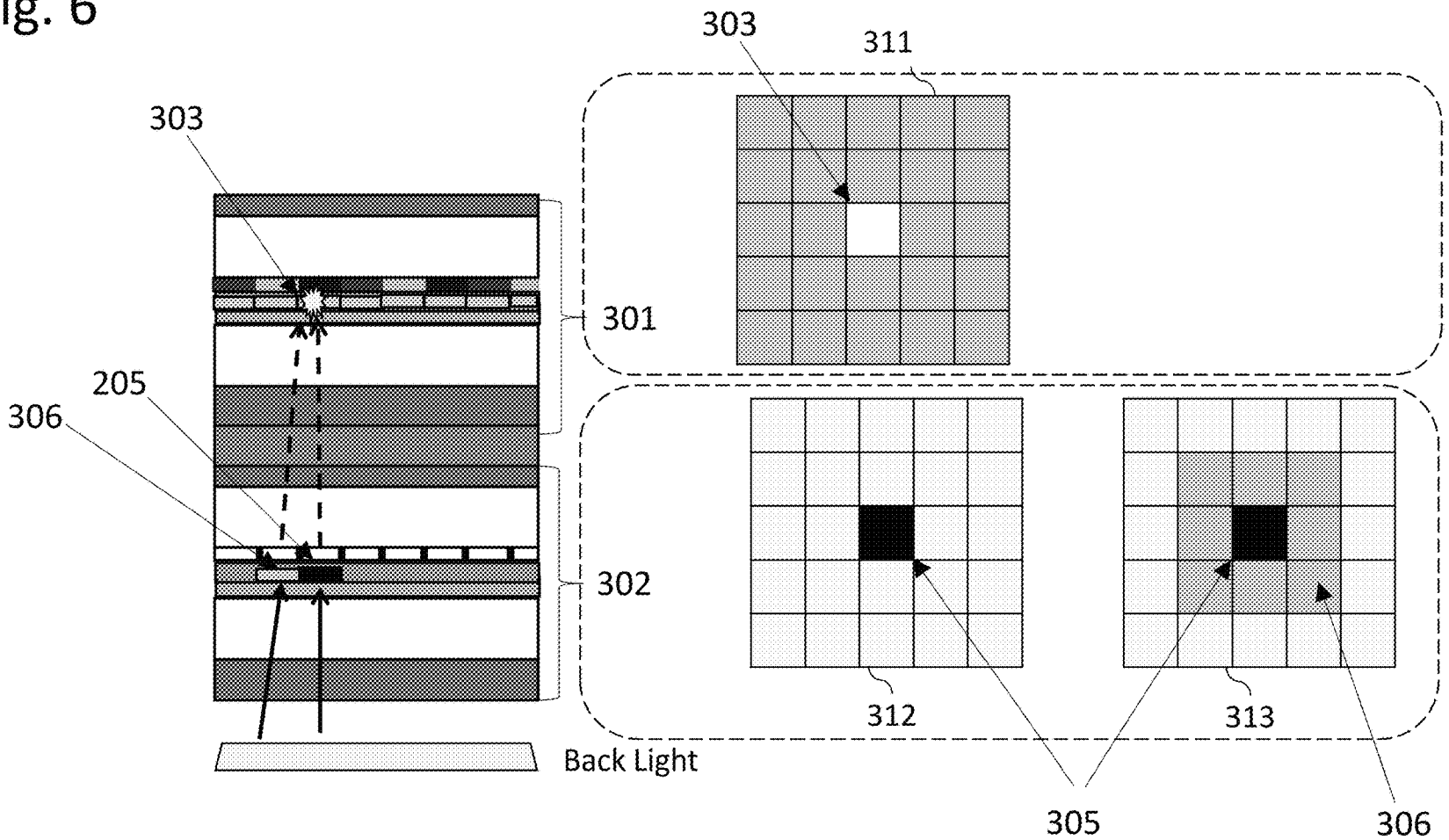
FIG. 6 is a schematic cross-sectional view of a liquid crystal display where the white spot defect is corrected according to another exemplary embodiment.

Turing to exemplary FIG. 6, FIG. 6 shows how the white spot defect 303 on the front LCD panel 301 is hidden by the overlapping pixel 305 and its adjacent pixels 306 on the back LCD panel 302, according to an exemplary embodiment. As shown in FIG. 6, to hide the white spot defect 303 on the front LCD panel 301, the back light may be blocked before reaching the white spot 303 by the overlapping pixel 305 and the adjacent pixels 306. Thus, according to an exemplary embodiment, the controller may change the gray scale levels of the overlapping pixel 305 and the adjacent pixels 306 to be darker than gray scale levels which should have been displayed on the overlapping pixel 305 and the adjacent pixels 306 based on the external input image signal. Thus, the white spot defect 303 may be hidden by the overlapping pixel 305 and the adjacent pixels 306, and, in this manner, human eyes may not recognize the white spot defect 303. Also, in another exemplary embodiment, the controller may change the gray scale level of the overlapping pixel 305 and the adjacent pixel 306 to be predetermined gray scale levels irrespective of the external input image signal. According to an exemplary embodiment, the amount of gray scale level which is displayed on the overlapping pixel 305 or the adjacent pixel 306 may be determined by considering the amount of the back light which can reach the white spot defect 303 after passing through the overlapping pixel 305 and the adjacent pixels 306. Also, in another exemplary embodiment, the amount of gray scale level which is displayed on the overlapping pixel 305 or the adjacent pixel 306 may be determined by considering the external input image data, or etc.

Figure 7:
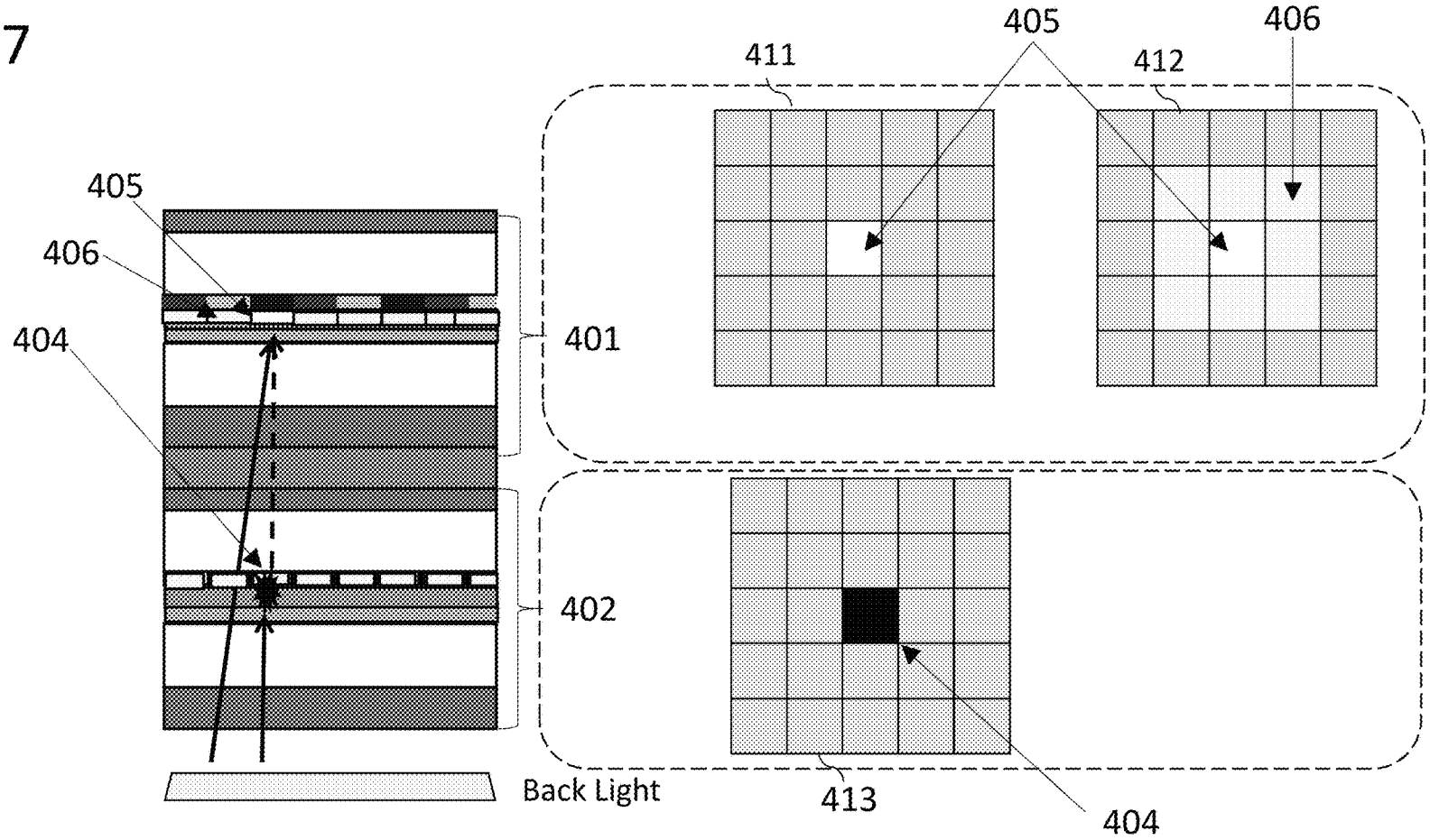
FIG. 7 is a schematic cross-sectional view of a liquid crystal display where the black spot defect is corrected according to an exemplary embodiment.

Turing to exemplary FIG. 7, FIG. 7 shows how the black spot defect 404 on the back LCD panel 402 is corrected by the overlapping pixel 405 and its adjacent pixels 406 on the front LCD panel 401 according to an exemplary embodiment. As shown in the cross-sectional view of FIG. 7, some portion of the back light cannot reach the front LCD panel 401 because the back light is blocked by the black spot defect 404 on the back LCD panel 402. To compensate for the luminescence which is reduced by the black spot defect 404 of the back LCD panel 402, the overlapping pixel 405 and its adjacent pixels 406 on the front LCD panel 401 may be controlled by the controller to display a brighter gray scale level according to an exemplary embodiment. In this manner, the black spot defect 404 may be hidden, and human eyes may not recognize the black spot defect 404. In the exemplary embodiment, the controller may change the gray scale levels of the overlapping pixel 405 and its adjacent pixels 406 brighter than gray scale levels which should have been displayed on the overlapping pixel 405 and its adjacent pixels 406 based on the external input image signal. Also, in another exemplary embodiment, the controller may change the gray scale levels of the overlapping pixel 405 and its adjacent pixels 406 to be predetermined gray scale levels irrespective of the external input image signal.

According to an exemplary embodiment, the amount of gray scale level which is displayed on the overlapping pixel 405 and the adjacent pixel 406 may be determined by considering the amount of the back light which is blocked by the black spot defect 404 before reaching the front LCD panel 401. Also, in another exemplary embodiment, the amount of gray scale level which is displayed on the overlapping pixel 405 and the adjacent pixel 406 may be determined by considering the external input image data, or etc.

Also, in another exemplary embodiment, the image data processor 102 may check if the gray scale level corresponding to the overlapping pixel or the adjacent pixels based on the external input image data is brighter or darker than predetermined gray scale levels which are the threshold levels for human eyes not to recognize the black spot defect 404. Here, if the external input image data is brighter than the predetermined gray scale, human eyes may recognize the black spot defect 404 because the external input image data would be shown darker than it should have been displayed due to the reduced luminescence by the black spot defect 404. On the other hand, if the external input image data is darker than the predetermined gray scale, human eyes may not recognize the black spot defect 404. Thus, if it is brighter than the predetermined gray scale levels, the controller may change the gray scale level of the overlapping pixel or the adjacent pixels to be brighter than the external input image data. However, the external input image data is darker than the predetermined gray scale levels, the controller may control the gray scale level of the overlapping pixel or the adjacent pixels to be maintained as the external input image data.

Also, in another exemplary embodiment, the image data processor 102 may compare the overlapping pixel 405 with non-overlapping pixels. The non-overlapping pixels may surround the overlapping pixel 405 on the same LCD panel (here, the front LCD panel 401), and the back light blocked by the black spot defect 404 does not give effect to the non-overlapping pixels. As described above, human eyes may recognize easily an unnatural difference between adjacent pixels. Thus, if the gray scale level of the overlapping pixels 405 and the non-overlapping pixels are same based on the external input image, the controller may control the overlapping pixel 405 to display brighter luminescence than the non-overlapping pixels displays (the image data processor 102 may generate the image data for the front LCD panel 401 using the defect position information stored in the memory of defective pixel where the overlapping pixel 405 displays brighter luminescence than the non-overlapping pixels displays).

Also, in anther exemplary embodiment, the image data processor 102, based on the external input image, may check if the gray scale level of the overlapping pixels 405 and the non-overlapping pixels is brighter than predetermined level, where the predetermined level is the threshold level for human eyes not to recognize the black spot defect 404. If the external input image data is brighter than the predetermined level, the controller may change the gray scale level of the overlapping pixels 405 to be brighter than the external input image data. Also, if the external input image data is darker than the predetermined level, the controller may control the gray scale level of the overlapping pixels 405 to be maintained as the external input image data. In another exemplary embodiment, the boundary between the overlapping pixels 405 and the non-overlapping pixels may not be strictly limited. For example, the overlapping pixels 405 may partially overlap the black spot defect 404, and the non-overlapping pixels, partially, may not overlap the black spot defect 404 (the back light blocked by the black spot defect 404 does partially give effects to the non-overlapping pixels, so the non-overlapping pixels may be the adjacent pixels 406).

Figure 8:
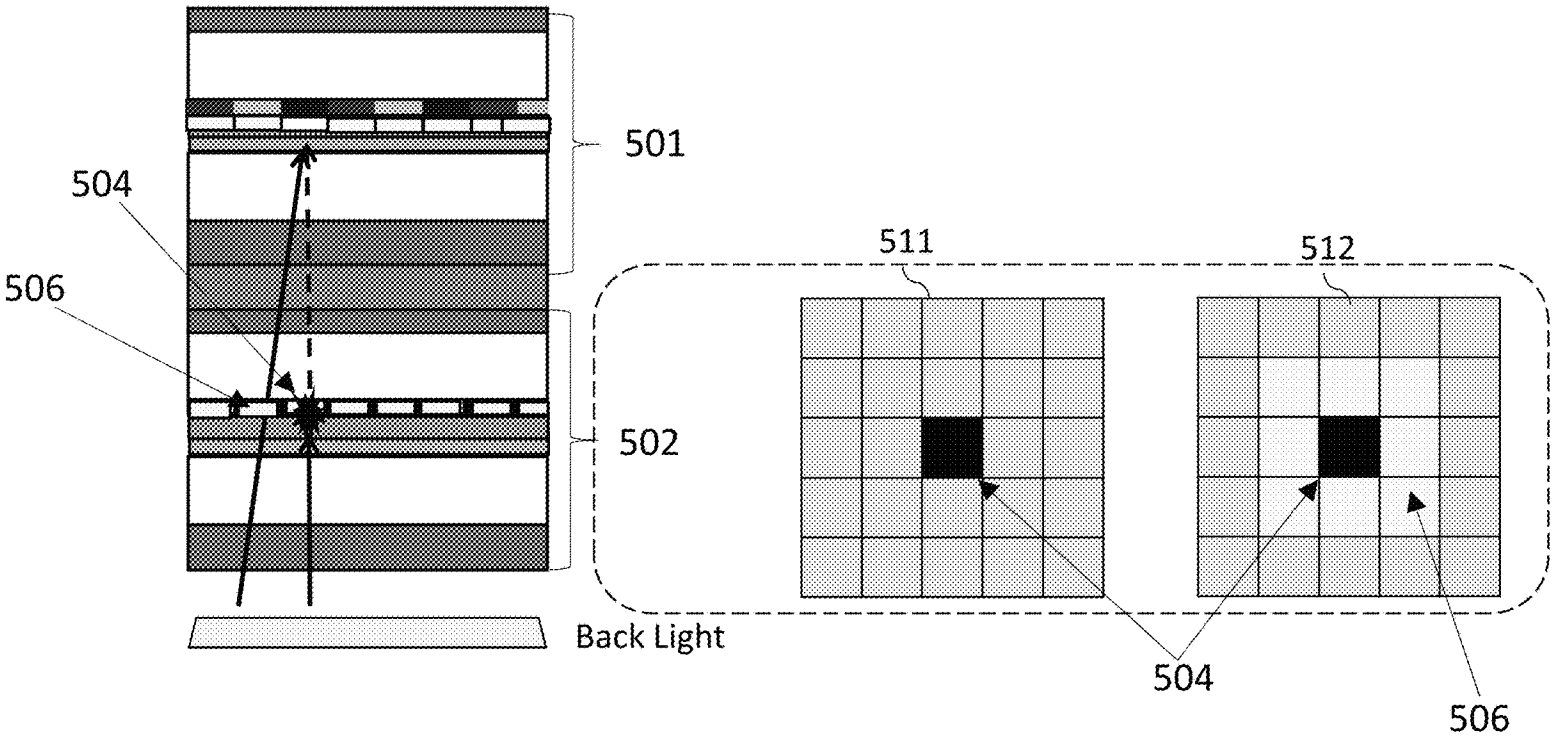
FIG. 8 is a schematic cross-sectional view of a liquid crystal display where the black spot defect is corrected according another an exemplary embodiment.

Turing to exemplary FIG. 8, FIG. 8 shows how the black spot defect 504 on the back LCD panel 502 is corrected by its adjacent pixels 506 on the back LCD panel 502 according to an exemplary embodiment. As shown in the cross-sectional view of FIG. 8, some portion of the back light cannot reach the front LCD panel 501 because the back light is blocked by the black spot defect 504 of the back LCD panel 502. To compensate for the luminescence that is reduced by the black spot defect 504, the pixels 506 adjacent to the black spot defect 504 may be controlled by the controller to display a brighter gray scale level according to an exemplary embodiment. In this manner, the black spot defect 504 may be compensated by the adjacent pixels 506, and human eyes may not recognize the black spot defect 504. In the exemplary embodiment, the controller may change the gray scale levels of the adjacent pixels 506 brighter than gray scale levels which should have been displayed on the adjacent pixels 506 based on the external input image signal. According to an exemplary embodiment, the amount of gray scale level which is displayed on the adjacent pixel 506 may be determined by considering the amount of the back light which is blocked by the black spot defect 504 before reaching the front LCD panel 501. Also, in another exemplary embodiment, the amount of gray scale level which is displayed on the adjacent pixel 506 may be determined by considering the external input image data, or etc.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An apparatus for Liquid Crystal Display (LCD) comprising:

a first LCD panel;

a second LCD panel stacked on the first LCD panel; and a data processor that generates, based on an external input image signal a first image data for the first LCD panel and a second image data for the second LCD panel;

wherein the data processor includes a memory storing a position of a defective pixel of white spot and a controller changing a gray scale level of a first pixel using the position of the defective pixel, the first pixel at least partially overlapping the position of the defective pixel, wherein the defective pixel is in the first LCD panel and the first pixel is in the second LCD panel, wherein the controller changes a gray scale level of the first pixel to be darker than a gray scale level corresponding to the first pixel based on the external input image signal, wherein the controller changes the gray scale level of the first pixel to a first predetermined gray scale level irrespective of the external input image signal.

2. The apparatus of claim 1, wherein the controller changes a gray scale level of a second pixel adjacent to the first pixel to be darker than a gray scale level corresponding to the second pixel based on the external input image signal.

3. The apparatus of claim 1, wherein the controller changes a gray scale level of a second pixel adjacent to the first pixel to be a second predetermined gray scale level irrespective of the external input image signal.

4. An apparatus for Liquid Crystal Display (LCD) comprising:

a first LCD panel;

a second LCD panel stacked on the first LCD panel; and a data processor that generates, based on an external input image signal, a first image data for the first LCD panel and a second image data for the second LCD panel;

wherein the data processor includes a memory storing a position of a defective pixel of white spot and a controller changing a gray scale level of a first pixel using the position of the defective pixel, the first pixel at least partially overlapping the position of the defective pixel, wherein the defective pixel is in the first LCD panel and the first pixel is in the second LCD panel, wherein the controller changes a gray scale level of the first pixel to be darker than a gray scale level corresponding to the first pixel based on the external input image signal, wherein:

the first LCD panel displays a monotonic image and the second LCD panel displays a color image;

the controller changes the gray scale level of the first pixel in the first LCD panel to be darker than a gray scale level corresponding to the first pixel based on the external input image signal when the gray scale level corresponding to the first pixel based on the external input image signal is darker than a second predetermined gray scale level; and the controller maintains the gray scale level of the first pixel to be a gray scale level corresponding to the first pixel based on the external input image signal when the gray scale level corresponding t to the first pixel based on the external input image signal is brighter than the second predetermined gray scale level.

5. An apparatus for Liquid Crystal Display (LCD) comprising:

a first LCD panel;

a second LCD panel stacked on the first LCD panel; and a data processor that generates, based on an external input image signal, a first image data for the first LCD panel and a second image data for the second LCD panel;

wherein the data processor includes a memory storing a position of a defective pixel of white spot, wherein the defective pixel and a non-defective pixel are in the first LCD panel and a first pixel and a second pixel are in the second LCD panel, the first pixel being at least partially overlaps the defective pixel and the second pixel being at least partially overlaps the non-defective pixel, wherein when a gray scale level corresponding to the first pixel and the second pixel are same based on the external input image signal, the data processor generates the second image data using the position of the defective pixel and the first pixel displays darker luminescence than the second pixel does according to the second image data, wherein the first LCD panel displays a monotonic image and the second LCD panel displays a color image, when a gray scale level corresponding to the first pixel and the second pixel are a first level based on the external input image signal, the first pixel displays darker luminescence than the second pixel does according to the second image data, when a gray scale level corresponding to the first pixel and the second pixel are a second level which is brighter than the first level based on the external input image signal, the first pixel displays same luminescence than the second pixel does according to the second image data.

6. A method for providing a display with a liquid crystal display (LCD) comprising:

generating, by a data processor, first image data for a first LCD panel and second image data for a second LCD panel stacked on the first LCD panel; and changing by the data processor, a gray scale level of a first pixel to be darker than a gray scale level corresponding to the first pixel based on an external input image signal, wherein the first pixel in a first LCD panel at least partially overlaps the position of the defective pixel of white spot in the second LCD panel in a plan view, wherein the gray scale level of the first pixel is changed to a first predetermined level irrespective of the external input image signal.

7. The method of claim 6, further comprising changing, by the data processor, a gray scale level of a second pixel adjacent to the first pixel to be darker than a gray scale level corresponding to the second pixel based on an external input image signal.

8. The method of claim 6, further comprising storing, by a memory, a position of the defective pixel, wherein the data processor changes the gray scale level of the first pixel using the position of the defective pixel.

* * * * *